US011146885B2

(12) United States Patent
Goller

(10) Patent No.: US 11,146,885 B2
(45) Date of Patent: Oct. 12, 2021

(54) LOUDSPEAKER ARRANGEMENT

(71) Applicant: Harman Becker Gepkocsirendszer Gyarto Kft., Székesfehérvár (HU)

(72) Inventor: Lars Goller, Stuer (DK)

(73) Assignee: Harman Becker Gepkocsirendszer Gyarto Kft., Székesfehérvár (HU)

( * ) Notice: Subject to any disclaimer, the term of this patent is extended or adjusted under 35 U.S.C. 154(b) by 0 days.

(21) Appl. No.: 16/754,705

(22) PCT Filed: Nov. 29, 2017

(86) PCT No.: PCT/EP2017/080867
§ 371 (c)(1),
(2) Date: Apr. 8, 2020

(87) PCT Pub. No.: WO2019/105547
PCT Pub. Date: Jun. 6, 2019

(65) Prior Publication Data

US 2020/0245060 A1 Jul. 30, 2020

(51) Int. Cl.

| | |
|---|---|
| ***H04R 1/28*** | (2006.01) |
| ***H04R 1/02*** | (2006.01) |
| ***H04R 1/22*** | (2006.01) |
| ***H04R 1/34*** | (2006.01) |

(52) U.S. Cl.
CPC ..... *H04R 1/2834* (2013.01); *H04R 1/02* (2013.01); *H04R 1/227* (2013.01); *H04R 1/345* (2013.01); *H04R 2499/13* (2013.01)

(58) Field of Classification Search
CPC ..... H04R 1/283; H04R 1/2834
See application file for complete search history.

(56) References Cited

U.S. PATENT DOCUMENTS

| | | | |
|---|---|---|---|
| 2006/0078136 | A1 | 4/2006 | Stiles et al. |
| 2007/0092096 | A1 | 4/2007 | Litovsky |
| 2014/0355806 | A1 | 12/2014 | Graff |

FOREIGN PATENT DOCUMENTS

| | | | |
|---|---|---|---|
| EP | 0273096 | A1 | 7/1988 |

OTHER PUBLICATIONS

ISA European Patent Office, International Search Report and Written Opinion Issued in Application No. PCT/EP2017/080867, dated Jul. 11, 2018, WIPO, 12 pages.

*Primary Examiner* — Kile O Blair
(74) *Attorney, Agent, or Firm* — McCoy Russell LLP

(57) ABSTRACT

A loudspeaker arrangement comprises an enclosure, at least one loudspeaker mounted in a wall of the enclosure between the inside and the outside of the enclosure and configured to produce sound waves, a first passive radiator mounted in a first wall of the enclosure between the inside and the outside of the enclosure, a second passive radiator mounted in a second wall of the enclosure between the inside and the outside of the enclosure, and a connecting element connecting the first passive radiator to the second passive radiator.

20 Claims, 5 Drawing Sheets

LOUDSPEAKER ARRANGEMENT

CROSS-REFERENCE TO RELATED APPLICATION

The present application is a U.S. National Phase of International Patent Application Serial No. PCT/EP2017/080867 entitled "LOUDSPEAKER ARRANGEMENT", filed on Nov. 29, 2017.

TECHNICAL FIELD

The disclosure relates to a loudspeaker arrangement, in particular a loudspeaker arrangement including passive radiators.

BACKGROUND

Passive radiators are used in loudspeaker arrangements to increase the low frequency response (bass) of the speaker system. A passive radiator usually is a speaker without a magnet and the corresponding electronic components that are connected to the magnet in a traditional loudspeaker. A passive radiator, therefore, usually only includes a cone (membrane), a suspension, and a frame. A passive radiator is a reactionary device. When a driver, e.g., a subwoofer, is mounted within the same speaker enclosure as the passive radiator, the physical movement (back/forth) of the driver membrane affects the internal air pressure of the enclosure. The fluctuations of the internal air pressure caused by the movement of the driving speaker cause the passive radiator to begin moving back and forth. When the passive radiator moves, it creates sound frequencies just as a normal (active) driver does. In some applications such as automotive applications, for example, using a passive radiator may be problematic because vibrations of the vehicle may cause an unwanted movement of the passive radiator. This may further cause unwanted movements of a driver mounted in the same speaker enclosure as the passive radiator.

SUMMARY

A loudspeaker arrangement comprises an enclosure, at least one loudspeaker mounted in a wall of the enclosure between the inside and the outside of the enclosure and configured to produce sound waves, a first passive radiator mounted in a first wall of the enclosure between the inside and the outside of the enclosure, a second passive radiator mounted in a second wall of the enclosure between the inside and the outside of the enclosure, and a connecting element connecting the first passive radiator to the second passive radiator.

Other devices, systems, methods, features and advantages will be or will become apparent to one with skill in the art upon examination of the following detailed description and figures. It is intended that all such additional systems, methods, features and advantages be included within this description, be within the scope of the invention and be protected by the following claims.

BRIEF DESCRIPTION OF THE DRAWINGS

The method may be better understood with reference to the following description and drawings. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
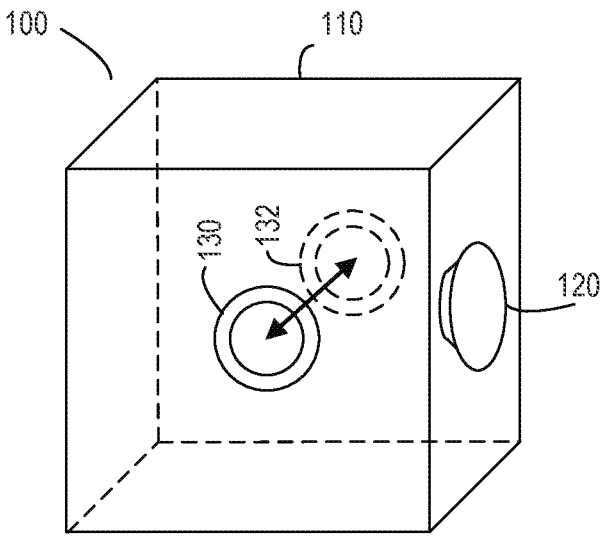
FIG. 1 is a schematic diagram of a loudspeaker arrangement.

Referring to FIG. 1, a loudspeaker arrangement 100 is illustrated. The loudspeaker arrangement 100 includes a closed enclosure 110. "Closed enclosure" in this context means that the enclosure does not have any apertures, openings or gaps through which air may enter or exit the enclosure. The enclosure 110 is illustrated having a square shape (cubic shape) in FIG. 1. However, this is only an example. The enclosure 110 may have any suitable shape. A loudspeaker 120 is mounted in a front panel of the enclosure 110 between the inside and the outside of the enclosure 110. This is, however, only an example. The loudspeaker 120 may also be mounted in a back panel, sidewall or any other wall or baffle of the enclosure 110. The loudspeaker 120 may be any transducer configured to convert electrical signals into sound waves. For example, the loudspeaker 120 may include a diaphragm attached to and driven by a voice coil, such as in a dynamic driver setup, a balanced armature setup, etc. When an electrical signal is applied to the loudspeaker 120, a force (e.g., a mechanical or magnetic force) causes the diaphragm to move back and forth, thereby reproducing sound under the control of the applied electrical signal.

When moving back and forth, the outward-facing surface of the diaphragm generates sound waves at the front of the loudspeaker 120 outside of the enclosure 110, and the inward-facing surface of the diaphragm generates sound waves at the back of the loudspeaker 120 inside the enclosure 110. The primary role of the enclosure 110 is to prevent the sound waves generated by the inward-facing surface of the diaphragm from interacting with the sound waves generated by the outward-facing surface of the diaphragm. The outward and inward generated sounds are usually out of phase with each other and an interaction between them generally results in cancellation of at least parts of the wanted sound signal. The enclosure 110 may further prevent echo and reverberation effects.

Figure 2:
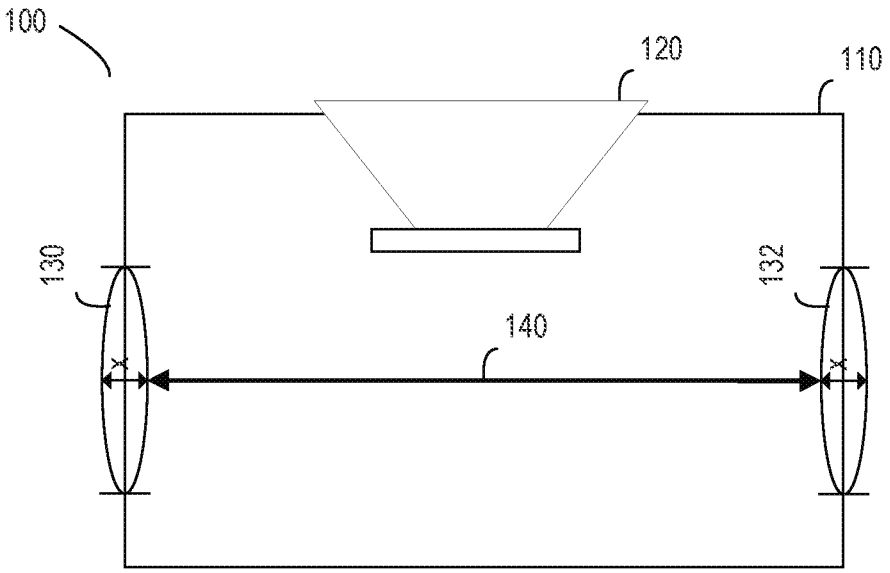
FIG. 2 is a schematic diagram illustrating a cross-section of a loudspeaker arrangement.

The loudspeaker arrangement 100 further includes a first passive radiator 130 and a second passive radiator 132. The passive radiators 130, 132 may be mounted in a front panel, sidewall or any other wall or baffle of the enclosure 110. The passive radiators 130, 132 each include a passive membrane 134 (see, e.g., FIG. 6). A passive membrane is a membrane that is stimulated through changes in the surrounding pressure, through vibrations, or through an acceleration or deceleration of the arrangement, for example. No actuators are used for the stimulation of a passive membrane. Therefore, when the pressure in the enclosure 110 changes due to the movement of the diaphragm of the loudspeaker 120, for example, the passive radiators 130, 132 are stimulated depending on the pressure inside the enclosure 110. This means that the passive radiators 130, 132 move around a resting position at a certain distance x. This is exemplarily illustrated in FIG. 2. The distance x may be variable depending on a current pressure inside the enclosure 110. The distance x may further be dependent on the material, the thickness, the mass or the surface area of the passive radiators 130, 132 and on how the membrane 134 of the passive radiators 130, 132 is fixed to the enclosure 110. The distance x generally refers to a deviation of a central point of the passive radiators 130, 132 from a resting position.

Figure 3A:
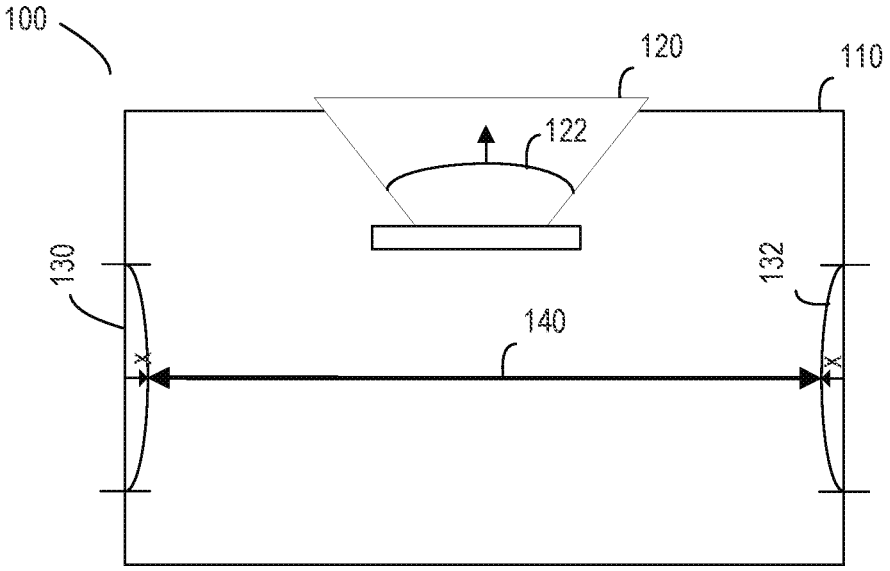
FIGS. 3A and 3B are schematic diagrams illustrating cross-sections of a loudspeaker arrangement.
Figure 3B:
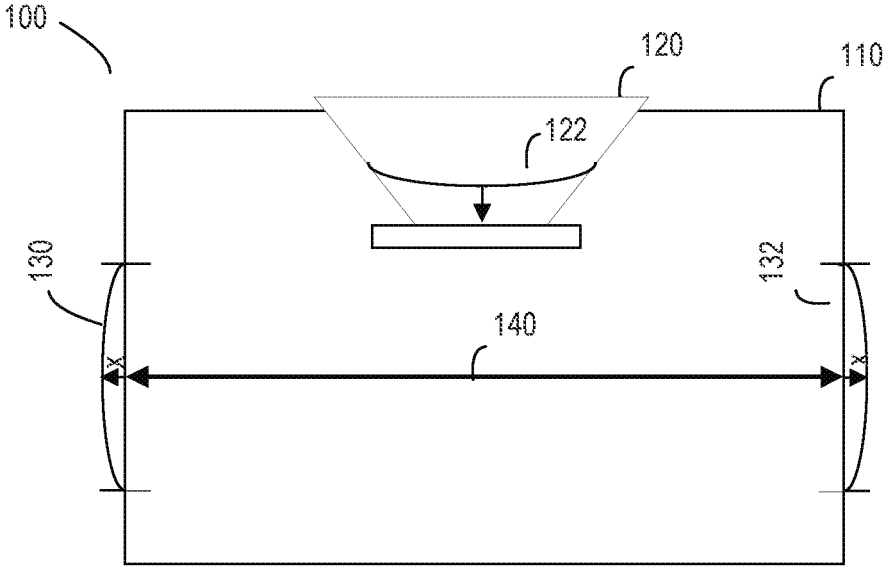

When stimulated by pressure changes inside the enclosure, the first passive radiator 130 and the second passive radiator 132 generally perform essentially similar movement. This means that when the diaphragm 122 of the loudspeaker 120 moves in a direction towards the outside of the enclosure 110, the first passive radiator 130 and the second passive radiator 132 will both move in a direction towards the inside of the enclosure 110. This is schematically illustrated in FIG. 3A. When the diaphragm 122 of the loudspeaker 120 moves in a direction towards the inside of the enclosure 110, the first passive radiator 130 and the second passive radiator 132 will both move in a direction towards the outside of the enclosure 110. This is schematically illustrated in FIG. 3B.

Problems, however, may arise when the enclosure 110 is mounted in a moving, vibrating, shaking or unstable environment such as a vehicle, for example. If the loudspeaker arrangement 100 is mounted in a vehicle, for example, vibrations of the vehicle that may be caused by the running engine or in any other way may be transferred to the enclosure 110. From the enclosure 110, the vibrations may then be transmitted to the membranes of the passive radiators 130, 132. As a result, the membranes of the passive radiators 130, 132 may vibrate in an uncontrolled manner.

If only one loudspeaker and one passive radiator are mounted in the same enclosure, external forces in a direction of travel of the diaphragm (membrane) of the passive radiator will cause the diaphragm of the passive radiator to move. This movement causes a pressure change within the enclosure which in turn will cause a movement of the diaphragm of the loudspeaker away from its resting position. This results in excessive distortion and may cause the passive radiator to reach its maximum possible excursion, causing the passive radiator to create a high degree of distortion. Any sound that is generated by the loudspeaker will be heavily distorted, because the passive radiator will not work as intended. If one loudspeaker and two passive radiators are mounted within the same enclosure and both passive radiators react to external forces as has been described with respect to one passive radiator above, this may cause both passive radiators to reach their maximum possible excursion, causing the passive radiators to create a high degree of distortion. No pressure effect will be produced inside the enclosure if both passive radiators perform opposing movements and are exposed to the same external forces. However, the sound produced by the loudspeaker will be heavily distorted, as the passive radiators will not work as intended. The vibrations of the first passive radiator 130 may not be simultaneous to the vibrations of the second passive radiator 132. For example, the membrane of the first passive radiator 130 may move in a direction towards the outside of the enclosure 110 and, at the same time, the membrane of the second passive radiator 132 may move in a direction towards the inside of the enclosure 110. Such an opposing, asymmetrical movement of the passive radiators 130, 132 may lead to heavy distortions, as has been described above. Furthermore, if the loudspeaker arrangement 100 is mounted in a vehicle, an acceleration and a deceleration of the vehicle may also cause an unwanted movement of the passive radiators 130, 132, for example. If a loudspeaker arrangement 100 is mounted in a room and is not exposed to any noticeable vibrations or acceleration/deceleration, the passive radiators 130, 132, however, may be influenced by gravity, for example, if they are not mounted in sidewalls of the enclosure but to a bottom panel and an upper panel of the enclosure, for example. In this case, gravity might cause one passive radiator to move in a direction towards the inside of the enclosure 110 (e.g., passive radiator mounted in upper wall of enclosure 110) and another passive radiator to move in a direction towards the outside of the enclosure 110 (e.g., passive radiator mounted in bottom wall of enclosure 110), for example. Such movements may be unwanted movements.

If the first passive radiator 130 moves uniformly (symmetrical) with the second passive radiator 132, meaning that the membrane of the first passive radiator 130 moves towards the inside of the enclosure 110 and, at the same time, the membrane of the second passive radiator moves towards the inside of the enclosure 110, these movements may cause an unwanted excitation of the membrane 122 of the loudspeaker 120. The same applies if the membrane of the first passive radiator 130 moves towards the outside of the enclosure 110 and, at the same time, the membrane of the second passive radiator moves towards the outside of the enclosure 110. For example, if the membranes of the first passive radiator 130 and the second passive radiator 132 both move in a direction towards the inside of the enclosure 110 at the same time, the membrane 122 of the loudspeaker 120 may be forced to move in a direction towards the outside of the enclosure 110. On the other hand, if the membranes of the first passive radiator 130 and the second passive radiator 132 both move in a direction towards the outside of the enclosure 110 at the same time, the membrane 122 of the loudspeaker 120 may be forced to move in a direction towards the inside of the enclosure 110. This may cause unwanted sound to be generated by the loudspeaker 120.

Therefore, the first passive radiator 130 and the second passive radiator 132 are connected to each other by means of a connecting element 140. The connecting element 140 may extend through (traverse) the inside of the enclosure 110. The connecting element 140 is configured to prevent non-simultaneous (asymmetrical) movements of the passive radiators 130, 132. This means that the connecting element 140 does not allow one of the passive radiators to move in a direction towards the inside of the enclosure 110 while the other passive radiator moves in a direction towards the outside of the enclosure 110. Furthermore, the connecting element 140 may also completely prevent unwanted movements of the passive radiators 130, 132 in some situations.

An exemplary connecting element 140 that may prevent unwanted movement of the passive radiators 130, 132 is schematically illustrated in FIG. 1 FIGS. 4A to 4C. The connecting element 140 in this example comprises a plate 142 that is pivoted about a bearing 144. A first connecting rod 146 is coupled to the plate 142 with a first end and with the first passive radiator 130 with a second end. The first connecting rod 146 may be coupled to the plate 142 via a joint (not illustrated) and may be coupled to the first passive radiator 130 via another joint. The first connecting rod 146 may be connected to the first passive radiator 130 at a point at the center of the membrane of the first passive radiator 130. A second connecting rod 148 is coupled to the plate 142 with a first end and to the second passive radiator 132 with a second end. The second connecting rod 148 may be coupled to the plate 142 via a joint (not illustrated) and may be coupled to the second passive radiator 132 via another joint. The second connecting rod 148 may be connected to the second passive radiator 132 at a point at the center of the membrane of the second passive radiator 132.

Figure 4A:
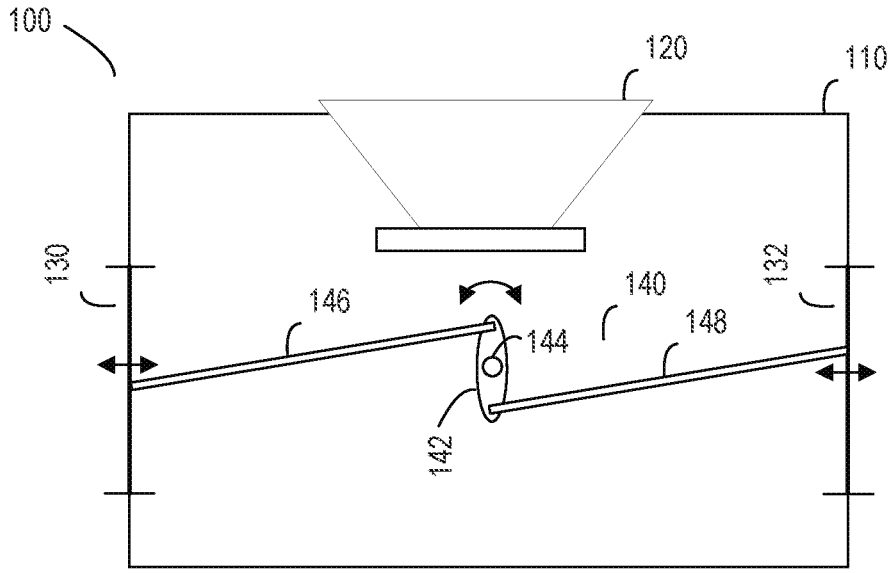
FIGS. 4A to 4C are schematic diagrams of a loudspeaker arrangement.

If, for example, the membrane of the first passive radiator 130 moves in a direction towards the outside of the enclosure 110, the first connecting rod 146 applies a first force to the plate 142 that causes the plate 142 to rotate in a first direction. If, at the same time, the membrane of the second passive radiator 132 moves in a direction towards the inside of the enclosure 110, the second connecting rod 148 applies a force to the plate 142 that causes the plate to rotate in a second direction opposite the first direction. If the two forces are essentially equal, they essentially eliminate each other and the plate essentially stays in a resting position as is schematically illustrated in FIG. 4A.

Figure 4B:
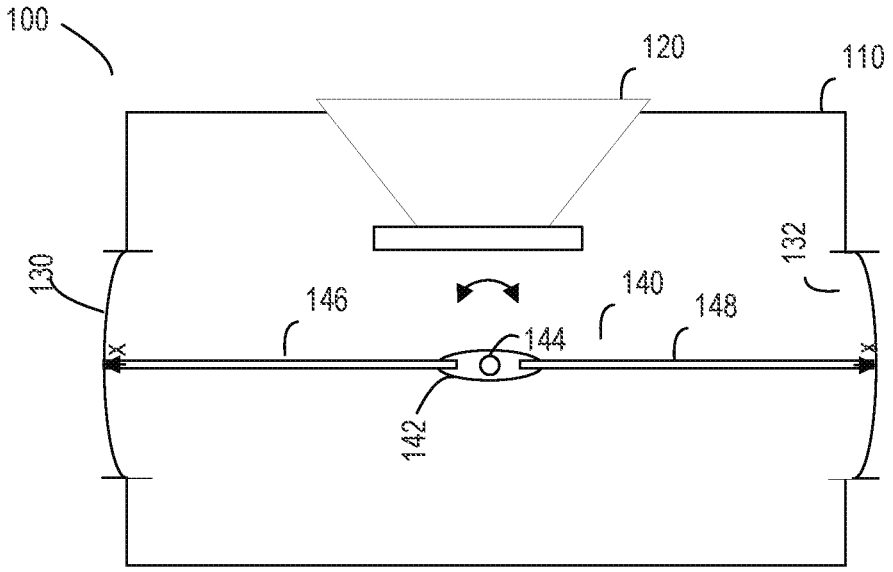

If, for example, the membrane of the first passive radiator 130 moves in a direction towards the outside of the enclosure 110, the first connecting rod 146 applies a first force to the plate 142 that causes the plate 142 to rotate in the first direction. If, at the same time, the membrane of the second passive radiator 132 moves in a direction towards the outside of the enclosure 110, the second connecting rod 148 applies a force to the plate 142 that also causes the plate to rotate in the first direction. The connecting element 140 allows such a symmetric movement of both passive radiators 130, 132 in a direction towards the outside of the enclosure 110 as is schematically illustrated in FIG. 4B.

If, for example, the membrane of the first passive radiator 130 moves in a direction towards the inside of the enclosure 110, the first connecting rod 146 applies a first force to the plate 142 that causes the plate 142 to rotate in the second direction. If, at the same time, the membrane of the second passive radiator 132 moves in a direction towards the inside of the enclosure 110, the second connecting rod 148 applies a force to the plate 142 that also causes the plate to rotate in the second direction. The connecting element 140 allows such a symmetric movement of both passive radiators 130, 132 in a direction towards the inside of the enclosure 110 as is schematically illustrated in FIG. 4C.

The first connecting rod 146 and the second connecting rod 148 may be coupled to the plate 142 at opposing ends in order to prevent an asymmetric (inconsistent) and to allow a symmetric (consistent) movement of the passive radiators 130, 132.

In this way, the passive radiators 130, 132 may perform wanted symmetric movements caused by the loudspeaker 120 and pressure changes inside the enclosure 110. Unwanted asymmetrical movements, however, may be prevented. The passive radiators 130, 132 may be at least essentially identical. For example, the first passive radiator 130 may have the same mass as the second passive radiator 132. The first passive radiator 130 may also have the same size and the same material as the second passive radiator 132, for example. The passive radiators 130, 132 having the same size, however, may not be necessary. If the passive radiators 130, 132 have the same mass but different sizes, they may still apply essentially equal forces to the plate which essentially cancel each other out. Essentially equal in this context means that the forces have an essentially equal absolute value. The forces, however, may cause a movement of the plate 142 in opposing directions such that they essentially cancel each other out, as has been described above.

Figure 4C:
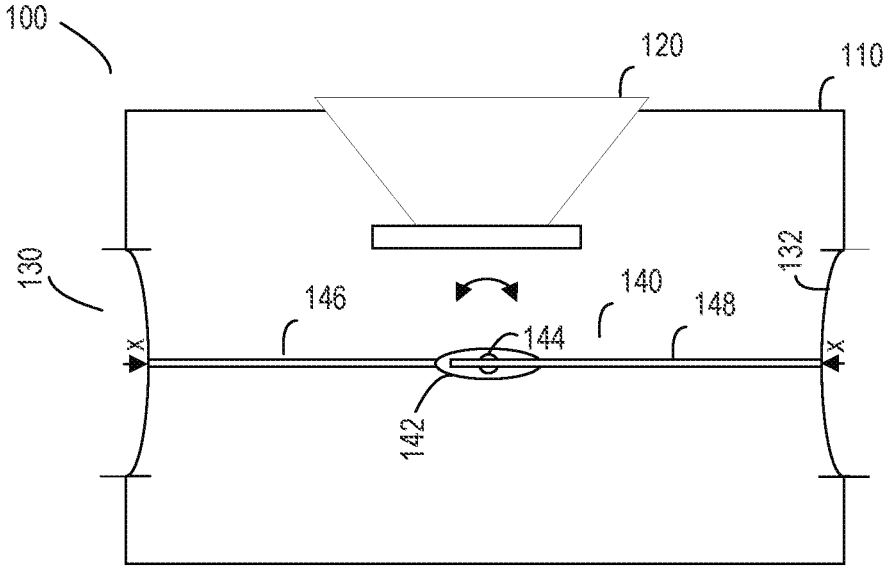
Figure 5:
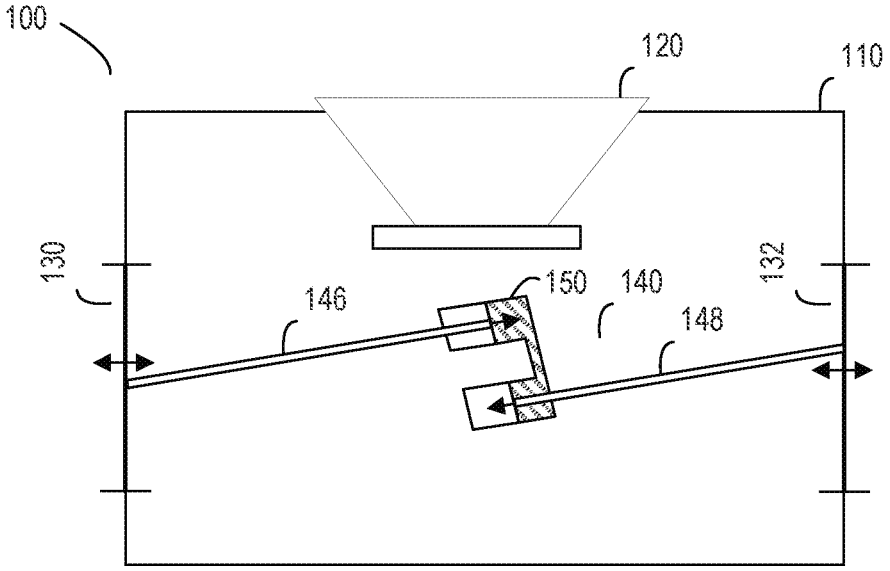
FIG. 5 is a schematic diagram of a loudspeaker arrangement.

The arrangement illustrated in FIGS. 4A to 4C, however, is only an example. The connecting element 140 may be implemented in any other suitable way. One further example of a connecting element 140 is schematically illustrated in FIG. 5. In the example illustrated in FIG. 5, the connecting element 140 comprises a hydraulic element 150. The first connecting rod 146 and the second connecting rod 148 may be coupled via the hydraulic element 150. The hydraulic element 150 may be at least partly filled with a fluid. If the first passive radiator 130 moves in a direction towards the inside of the enclosure 110, the first connecting rod 146 moves such that the fluid inside the hydraulic element 150 is pushed towards the second connecting rod 148, pushing the second connecting rod 148 in a direction which causes the second passive radiator 132 to move in a direction towards the inside of the enclosure 110. Therefore, if the second passive radiator 132 at the same time performs a movement towards the outside of the enclosure 110 due to vibrations of the enclosure 110, for example, the second connecting rod 148 is pushed in a direction opposing the movement caused by the first passive radiator. In this way, asymmetrical movements of the passive radiators 130, 132 (one passive radiator moves towards the inside of the enclosure while the other passive radiator moves towards the outside of the enclosure) cancel each other out if the passive radiators 130, 132 have essentially the same mass. This principle is the same as has been explained with reference to FIG. 1 FIGS. 4A to 4C above. The connecting element 140 may be implemented in any other suitable way.

Figure 6:
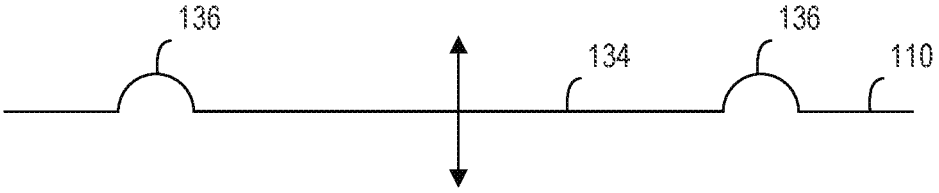
FIG. 6 schematically illustrates an example of a passive radiator.

Referring to FIG. 6, a passive radiator is schematically illustrated in further detail. A passive radiator generally includes a membrane (diaphragm) 134, as has been explained above. The membrane 134 may include an elastic material such as rubber, latex, polypropylene, textile fabric or woven fabric, for example. The membrane 134 may also include a material that is, at least virtually, not stretchable in one or multiple dimensions, but is still bendable such as glass fibre or carbon, for example. The membrane 134 may be fixed to the enclosure 110 using a glue or an adhesive which may optionally also be flexible. The fixation of the membrane to the enclosure may also include one or more flexible suspensions 136 that support movements, especially movements of membrane materials that are not or only slightly flexible or stretchable along their main dimensions (width and length). The one or more suspensions 136 may have a compliance or resilience that allows a motion of the membrane in a direction that is perpendicular (normal) to the surface of the membrane. These are, however, only examples. The membrane 134 may be fixed to the enclosure 110 in any other way that allows a vibration of the membrane 134 in response to a change of pressure within the enclosure 110, in response to an acceleration or deceleration of the enclosure 110, or in response to vibrations of the enclosure 110. Such membrane vibrations may include a movement of the whole membrane 134 or only parts of the membrane. To adjust the membrane weight, flexibility and/or stiffness, the material or material mix of the membrane 134 and/or suspension 136 may be chosen accordingly. Furthermore, the thickness of at least parts of the membrane 134 may be adjusted to control the membrane weight, flexibility and/or stiffness. Adjustments of thickness may induce thickness patterns that control the flexibility of the membrane 134. Flexibility, shape, size and weight of the membrane 134 may further be adjusted to control the distance x that the membrane 134 moves out of its resting position.

In general, the mass of the membrane and the compliance of the one or more suspensions determine a free air resonance frequency that is measured in Hz. The free air resonance frequency is the resonance frequency of the passive radiator when not mounted in an enclosure. If such a passive radiator, however, is mounted in an enclosure with a given enclosure volume, it will have another resonance frequency, different to the free air resonance frequency, which is given by the volume of the enclosure (added stiffness), the membrane surface area, the moving mass of the membrane and the suspension compliance of the passive radiator. This new resonance frequency, which is generally referred to as tuning frequency of the passive radiator, is the frequency at which the passive radiator will resonate when it is set in motion by a movement of an active driver (loudspeaker) that is mounted in the same enclosure. The membrane of the passive radiator moves in phase (outwards movement of active driver=outwards movement of passive radiator) with the diaphragm of the active driver at the tuning frequency. At frequencies below or above the tuning frequency, the movement of the passive radiator will gradually move out of phase with the active driver. At a static pressure, the passive radiator moves out of phase (opposing movement) with the outside facing diaphragm of the active driver that is mounted within the same enclosure.

The loudspeaker 120 may be configured to reproduce low or very low frequencies, for example. Loudspeakers that are configured to reproduce low frequencies are generally known as woofers, whereas loudspeakers that are configured to generate very low frequencies are generally known as subwoofers, for example. When playing sound or music, it is generally necessary to also reproduce middle and high frequencies. Additional loudspeakers may be integrated in the same enclosure 110 or in different enclosures that are arranged adjacent or in close proximity to the enclosure 110. Loudspeakers that are configured to generate middle frequencies are generally known as mid-range speakers and loudspeakers that are configured to generate high frequencies are also known as tweeters. In many cases, maximum sound pressure levels that a loudspeaker is able to produce are reduced with a decreasing frequency of the sound signal. The use of passive radiators 130, 132 may enhance the perception of low or very low frequencies, for example. The proposed loudspeaker arrangement, however, is not restricted to loudspeaker arrangements comprising loudspeakers 120 that produce low frequencies, but may also be used for fullrange loudspeakers, for example, which cover large parts of the audible frequency range and which are optionally used without any additional loudspeakers that could support frequency ranges outside the frequency range of the fullrange loudspeaker.

Figure 7:
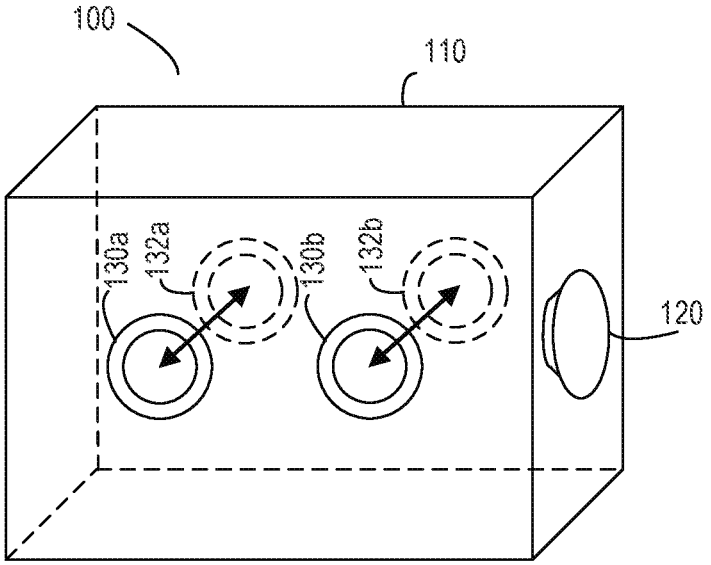
FIG. 7 is a schematic diagram illustrating a loudspeaker arrangement.

In the examples illustrated in FIGS. 1 to 5, the loudspeaker arrangement 100 only comprises one pair of passive radiators 130, 132 that are coupled by a connecting element 140. The passive radiators 130, 132 in the examples are mounted in opposing walls of the enclosure 110. The loudspeaker arrangement 100, however, may include more than one pair of passive radiators 130, 132. As is schematically illustrated in FIG. 7, the loudspeaker arrangement 100 may include two pairs of passive radiators. A first passive radiator 130*a* and a second passive radiator 132*a* form a first pair of passive radiators. The first passive radiator 130*a* is coupled to the second passive radiator 132*a* with a first connecting element, as has been described above. A third passive radiator 130*b* and a fourth passive radiator 132*b* form a second pair of passive radiators. The third passive radiator 130*b* is coupled to the fourth passive radiator 132*b* with a second connecting element. In the example illustrated in FIG. 7, the first passive radiator 130*a* is mounted to the same wall of the enclosure 110 as the third passive radiator 130*b*, and the second passive radiator 130*b* is mounted in the same wall of the enclosure 110 as the fourth passive radiator 132*b*. The walls in the example of FIG. 7 are sidewalls of the enclosure 110. This, however, is only an example. Instead of or additionally to one or more pairs of passive radiators in the sidewalls of the enclosure 110, one or more pairs of passive radiators may be mounted to a bottom wall and an upper wall of the enclosure, for example.

Generally, speaking, a first passive radiator of a pair of passive radiators may be mounted in a first wall of the enclosure 110 and a second passive radiator of the same pair of passive radiators may be mounted in a second wall of the enclosure 110, wherein the first wall and the second wall are opposing walls.

Figure 8:
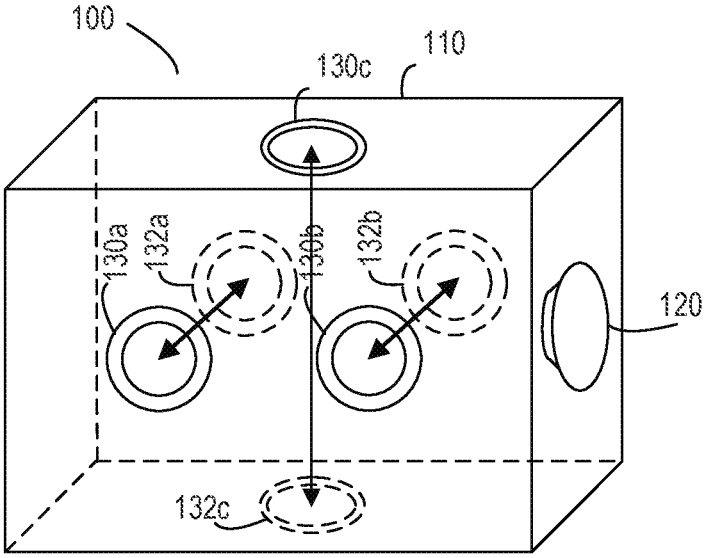
FIG. 8 is a schematic diagram illustrating a loudspeaker arrangement.

Referring to FIG. 8, a fifth passive radiator 130*c* may be mounted in an upper wall of the enclosure 110 and a sixth passive radiator 132*c* may be mounted in a bottom wall of the enclosure 110. In the example of FIG. 8, the loudspeaker arrangement 100 includes three pairs of passive radiators. However, it is also possible that the loudspeaker arrangement 100 only includes the first pair of passive radiators or only the third pair of passive radiators. Any other number n of pairs of passive radiators is possible, with $n \geq 1$.

With a connecting element 140 that connects one passive radiator 130 with another passive radiator 132, unwanted movements caused by vibrations or by gravity, for example, may be prevented. Wanted movements caused by the loudspeaker 120, however, are possible.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

The invention claimed is:

1. A loudspeaker arrangement comprising:

an enclosure;

at least one loudspeaker mounted in a wall of the enclosure and operable to produce sound waves;

a first passive radiator mounted in a first wall of the enclosure;

a second passive radiator mounted in a second wall of the enclosure; and a connecting element connecting the first passive radiator to the second passive radiator, wherein the connecting element is operable to allow a symmetrical movement of the passive radiators.

2. The loudspeaker arrangement of claim 1, wherein the first passive radiator is movable in a direction towards an inside of the enclosure and in an opposing direction towards an outside of the enclosure;

the second passive radiator is movable in a direction towards the inside of the enclosure and in an opposing direction towards the outside of the enclosure; and wherein the connecting element is operable to allow a symmetrical movement of the passive radiators towards the inside of the enclosure;

allow a symmetrical movement of the passive radiators towards the outside of the enclosure; and prevent an asymmetrical movement of the passive radiators, in which one passive radiator moves towards the inside of the enclosure and the other passive radiator moves towards the outside of the enclosure.

3. The loudspeaker arrangement of claim 1, wherein the first wall and the second wall are opposing walls.

4. The loudspeaker arrangement of claim 1, wherein the first passive radiator (130) and the second passive radiator form a first pair of passive radiators, and the loudspeaker arrangement further comprises at least one additional pair of passive radiators.

5. The loudspeaker arrangement of claim 1, wherein the connecting element comprises a first connecting rod and a second connecting rod.

6. The loudspeaker arrangement of claim 5, wherein the first connecting rod is coupled to the second connecting rod via a plate that is operable to pivot about a bearing.

7. The loudspeaker arrangement of claim 6, wherein the first connecting rod is coupled to a first end of the plate and the second connecting rod is coupled to a second end of the plate, and wherein the first end and the second end are opposing ends of the plate.

8. The loudspeaker arrangement of claim 5, wherein the first connecting rod is coupled to the second connecting rod via a hydraulic element.

9. The loudspeaker arrangement of claim 8, wherein the hydraulic element is at least partly filled with a fluid.

10. The loudspeaker arrangement of claim 1, wherein the first passive radiator comprises a first membrane and the second passive radiator comprises a second membrane.

11. The loudspeaker arrangement of claim 10, wherein each of the first membrane and the second membrane is coupled to the enclosure by means of a flexible suspension that is operable to enable movement of the membranes.

12. The loudspeaker arrangement of claim 10, wherein each of the first membrane and the second membrane is fixed to the enclosure by at least one of: a glue; or an adhesive.

13. The loudspeaker arrangement of claim 1, wherein the first passive radiator has substantially the same mass as the second passive radiator.

14. The loudspeaker arrangement of claim 1, wherein the first passive radiator has substantially the same size as the second passive radiator.

15. The loudspeaker arrangement of claim 1, wherein the connecting element extends through an inside of the enclosure.

16. The loudspeaker arrangement of claim 1, wherein the loudspeaker arrangement is mounted in a vehicle.

17. The loudspeaker arrangement of claim 1, wherein the first passive radiator has substantially the same mass and substantially the same size as the second passive radiator.

18. The loudspeaker arrangement of claim 17, wherein the pair of passive radiators comprises a corresponding pair of membranes, each of which is coupled to the enclosure by means of a flexible suspension.

19. A loudspeaker arrangement comprising:

an enclosure;

at least one loudspeaker mounted in a wall of the enclosure and operable to produce sound waves;

a first passive radiator mounted in a first wall of the enclosure;

a second passive radiator mounted in a second wall of the enclosure; and a connecting element connecting the first passive radiator to the second passive radiator, wherein the first passive radiator and the second passive radiator form a pair of passive radiators mounted in opposing walls of the enclosure; and wherein the connecting element extends through an inside of the enclosure, and is operable to:

allow a symmetrical movement of the pair of passive radiators; and prevent an asymmetrical movement of the pair of passive radiators.

20. The loudspeaker arrangement of claim 19, wherein the connecting element comprises a first connecting rod and a second connecting rod; and wherein the first connecting rod is coupled to the second connecting rod via one of: a plate that is operable to pivot about a bearing; and a hydraulic element.

* * * * *